US006720942B2

(12) United States Patent
Lee et al.

(10) Patent No.: US 6,720,942 B2
(45) Date of Patent: Apr. 13, 2004

(54) FLAT-PANEL LIGHT EMITTING PIXEL WITH LUMINANCE FEEDBACK

(75) Inventors: Paul P. Lee, Pittsford, NY (US); Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 154 days.

(21) Appl. No.: 10/074,541

(22) Filed: Feb. 12, 2002

(65) Prior Publication Data

US 2003/0151569 A1 Aug. 14, 2003

(51) Int. Cl.[7] ..... G09G 3/32
(52) U.S. Cl. ..... 345/82; 345/76
(58) Field of Search ..... 345/76, 77, 78, 345/82, 83

(56) References Cited

U.S. PATENT DOCUMENTS

| | | | | |
|---|---|---|---|---|
| 4,769,292 A | | 9/1988 | Tang et al. | 428/690 |
| 5,061,569 A | | 10/1991 | VanSlyke et al. | 428/457 |
| 5,157,525 A | | 10/1992 | Eaton et al. | 345/87 |
| 5,216,504 A | | 6/1993 | Webb et al. | 348/190 |
| 5,371,537 A | | 12/1994 | Bohan et al. | 348/181 |
| 5,910,792 A | | 6/1999 | Hansen et al. | 345/74.1 |
| 5,929,845 A | | 7/1999 | Wei et al. | 345/156 |
| 6,320,325 B1 | | 11/2001 | Cok et al. | 315/169.3 |
| 6,392,617 B1 | * | 5/2002 | Gleason | 345/82 |
| 6,542,138 B1 | * | 4/2003 | Shannon et al. | 345/76 |

FOREIGN PATENT DOCUMENTS

| | | |
|---|---|---|
| EP | 1096466 A1 | 5/2001 |
| EP | 1194013 A1 | 4/2002 |
| WO | WO 01/15232 A1 | 3/2001 |

* cited by examiner

*Primary Examiner*—Richard Hjerpe
*Assistant Examiner*—Kevin Nguyen
(74) *Attorney, Agent, or Firm*—Thomas H. Close

(57) ABSTRACT

An image display includes an addressable image display pixel, having a substrate; a light emitter formed on the substrate; a photo-sensor formed on the substrate and optically coupled to the light emitter to detect light emitted by the light emitter to generate a feedback voltage signal in response to light emitted by the light emitter; and, a feedback readout circuit formed on the substrate and responsive to the feedback voltage signal to provide a feedback signal representing the light output of the light emitter, the feedback readout circuit including a transistor amplifier, means for resetting the readout circuit, and a select switch.

25 Claims, 4 Drawing Sheets

FLAT-PANEL LIGHT EMITTING PIXEL WITH LUMINANCE FEEDBACK

FIELD OF THE INVENTION

The present invention relates to solid-state flat-panel display devices and more particularly to such display devices having means to optimize the luminance of pixels in the display through the use of optical feedback information from the pixels.

BACKGROUND OF THE INVENTION

Solid-state organic light emitting diodes (OLEDs) are of great interest for use in flat-panel digital display devices. These display devices utilize current passing through thin films of organic material to generate light. OLED materials are also responsive to electromagnetic radiation and, when appropriately biased within an electrical circuit, can produce a current dependent on the ambient light. For example, U.S. Pat. No. 5,929,845, issued Jul. 27, 1999 to Wei et al., describes a system that both emits and detects light using an organic electro-luminescent apparatus.

The luminous efficiency of the OLED devices often decreases significantly with operation due to the instability of the organic materials. This instability may be as a result of aging, usage, temperature changes, humidity, or other environmental stresses. Light output can vary from pixel to pixel due to processing variations, as well, causing display uniformity problems.

Attempts have been made in the prior art to optimize particular display systems to overcome some of the problems noted above. For example, U.S. Pat. No. 5,216,504 issued Jun. 1, 1993 to Webb et al. describes a digital control device within a video monitor to calibrate or otherwise optimize the display, either with human input or under automated computer control.

Some systems integrate user-controlled mechanisms to provide more flexible operation or optimal use under varying conditions. For example, brightness and contrast controls are often available on CRT and LCD display devices. These controls can be based on information from the device itself, using a reference pixel within the display. U.S. Pat. No. 5,157,525; issued Oct. 20, 1992 to Eaton et al. describes the use of a reference pixel with separate control to maintain a pre-selected value for contrast or absolute brightness using a feedback arrangement which includes an LCD reference element. The feedback information is determined by measuring the average transmissivity of the LCD material with a photo-detector.

U.S. Pat. No. 5,910,792 issued Jun. 8, 1999 to Hansen et al. compares current passing through a resistive layer with that of a current source to provide a feedback compensation for temperature-induced brightness variation. It is also known to calibrate display devices through the use of external sensors which measure the light output from the display device and construct a calibration table for use by the device. See for example U.S. Pat. No. 5,371,537, issued Dec. 6, 1994 to Bohan et al. This approach has the problem that the sensor device obscures the display during the calibration and is not capable of providing real time operation. Another problem with these approaches is that the feedback does not directly respond to the emissivity of the pixels themselves, or address problems with different types (e.g. colors) of pixels within a display. Moreover, these approaches are not useful for correcting uniformity variations among individual pixel display elements.

There is a need therefore for an improved addressable display pixel design providing optical feedback that avoids the problems noted above.

SUMMARY OF THE INVENTION

The need is met according to the present invention by providing an image display that includes an addressable image display pixel, having a substrate; a light emitter formed on the substrate; a photo-sensor formed on the substrate and optically coupled to the light emitter to detect light emitted by the light emitter to generate a feedback voltage signal in response to light emitted by the light emitter; and, a feedback readout circuit formed on the substrate and responsive to the feedback voltage signal to provide a feedback signal representing the light output of the light emitter, the feedback readout circuit including a transistor amplifier, means for resetting the readout circuit, and a select switch.

ADVANTAGES

The advantages of this invention are the ability to correct for non-uniformity and the ability to correct for changes due to aging in emissive digital image display devices.

DETAILED DESCRIPTION OF THE INVENTION

Figure 1:
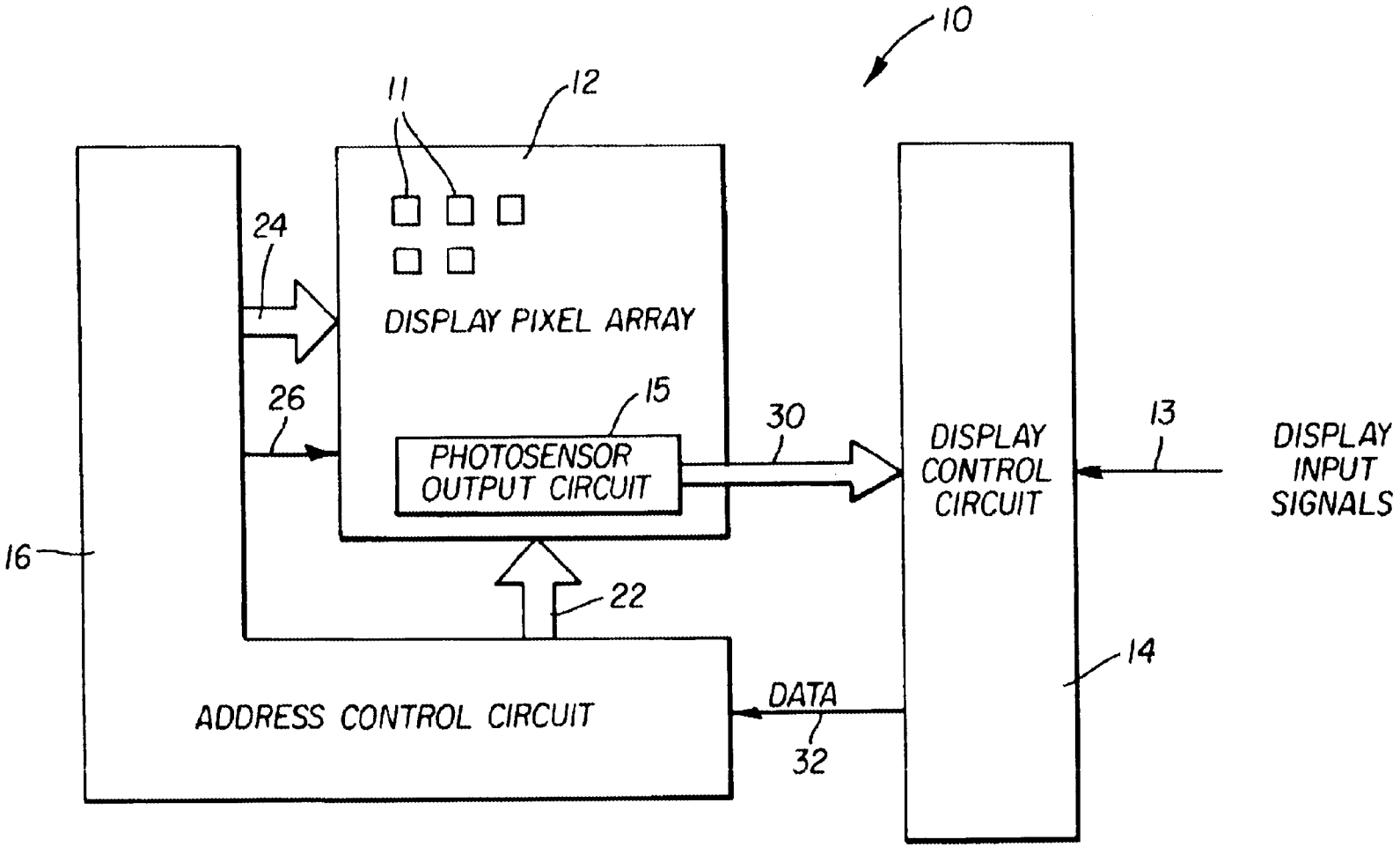
FIG. 1 is a schematic block diagram of a display device having addressable pixels according to one embodiment of the present invention.

Referring to FIG. 1, an image display 10 includes a display pixel array 12 having an array of addressable pixels 11 including light emitters and photo-sensors as described below. The photo-sensors can be photodiodes or photo-capacitors. In the case of a photo-capacitor, the feedback readout circuit further includes a transfer gate for transferring photo charge from photo-capacitor to the transistor amplifier as is known in the art. The photo-sensors in the addressable pixels 11 are readout by an output circuit 15 that operates in the same way as the output circuit in a conventional photodiode or photo-capacitor image sensor array. A display control circuit 14 receives a feedback signal 30 from the display pixel array 12 and display input signals 13 from an external source and modifies the display input signals according to the feedback signals to form data signals 32 that are compensated for the light output of the addressable pixels 11 of the display. An address control circuit 16 is responsive to the data signals 32 to produce compensated data signals 22, select signals 24 and a reset signal 26 that are used to drive the addressable pixels 11 of the array 12.

The address control circuit 16 can be embodied as an analog circuit or a computer with a memory containing instructions and data and a central processing unit. The address control circuit 16 writes data to addressable pixels 11 using, data, select, and reset signals, represented by signals 22, 24, and 26, respectively. Feedback signals 30 generated by the photo-sensor(s) within the addressable pixels are passed to the display control circuit 14, processed, and the resulting data signals 32 passed to the address control circuit 16.

Figure 4:
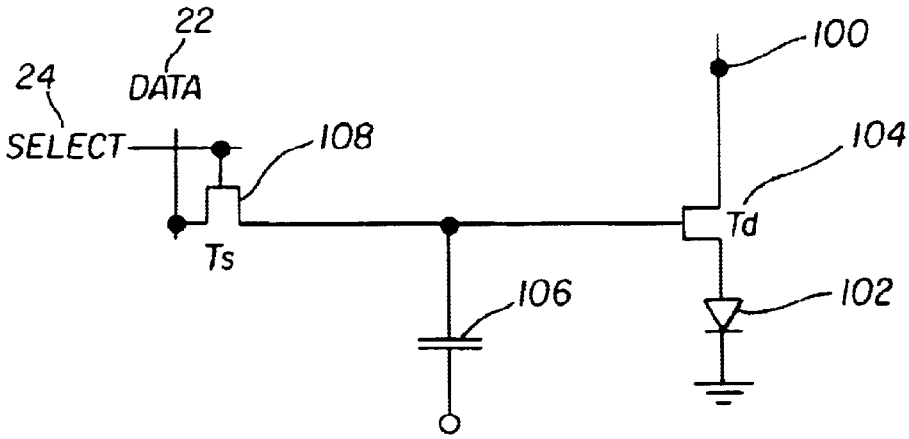
FIG. 4 (Prior Art)
FIG. 4 is a circuit diagram of a prior art emissive LED.

FIG. 4 illustrates an addressable light-emitting pixel as is known in the prior art. The addressable pixel includes a drive circuit for driving a light emitting diode LED 102. A Vdd power line 100 supplies power to the LED 102 through drive transistor 104. The drive transistor 104 is responsive to a voltage generated by a charge stored in capacitor 106. The charge is deposited by transistor 108 in response to signals on data and select lines 22 and 24 respectively as is well known in the prior art.

Figure 2:
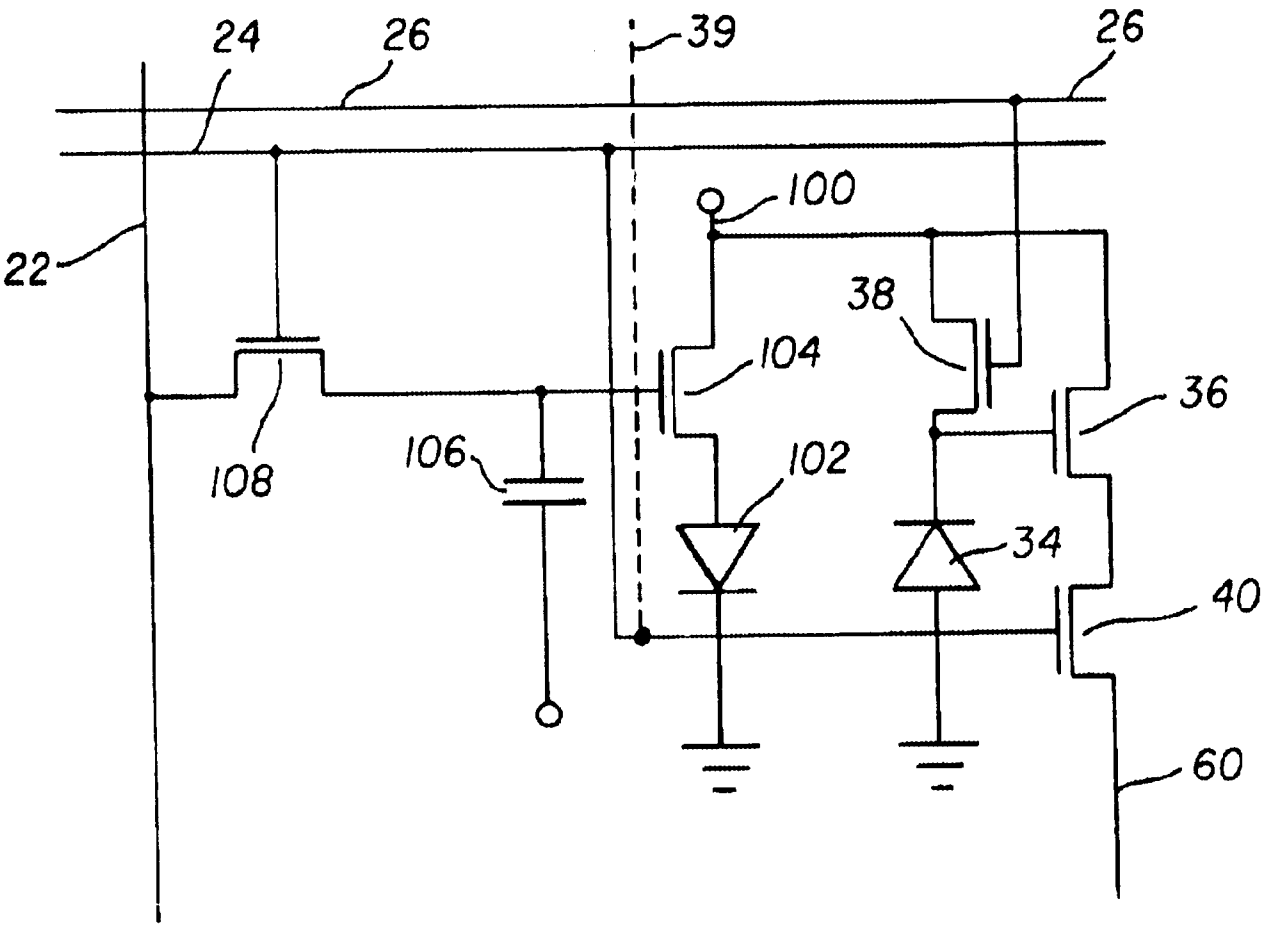
FIG. 2 is a circuit diagram of an embodiment of a display device pixel according to the present invention.
Figure 3:
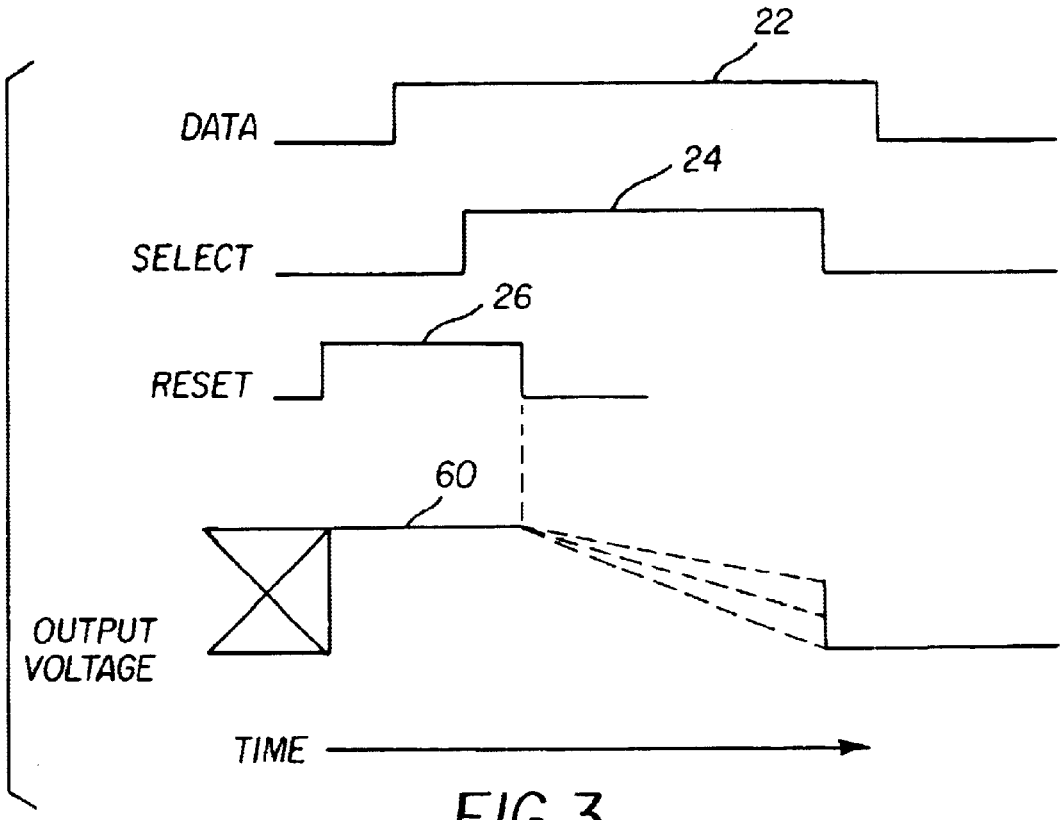
FIG. 3 is a timing diagram illustrating the operation of one embodiment of a display device pixel according to the present invention.

Referring to FIG. 2, according to one embodiment of the present invention the addressable pixel 11, in addition to including the light emitter drive circuit of FIG. 4, further includes a photo-sensor that is located on the same substrate as the light emitter 102 and is optically coupled thereto. The photodiode 34 can for example be a photodiode as shown, or a photo-capacitor (not shown). The addressable pixel 11 further includes a feedback read-out circuit on the same substrate having a transistor amplifier 36, a read-out transistor 40, and a reset transistor 38 driven by a reset signal 26. The transistor amplifier 36 amplifies the signal from the photodiode 34 and supplies a feedback voltage signal to the read-out transistor 40 to provide a feedback signal representing the light output of the light emitter. The read-out transistor 40 is configured as a switch responsive to a select signal to cause the feedback signal on line 60 to be read out. The select signal applied to read-out transistor 40 can be the same select signal 24 used to control the depositing of charge on the capacitor 106. Alternatively the select signal can be a separate photo-sensor select signal that is applied on a separate external photo sensor select line 39 as shown with a dotted line Timing for the circuit shown in FIG. 2 is illustrated in FIG. 3. Referring to FIG. 3, when data is available to be transferred to a pixel the data signal 22 is shown as high. During the time that data is available, the select signal 24 is applied to transistor 108 to cause a charge representing the data to be deposited on the capacitor 106. The charge on capacitor 106 quickly settles to the new desired data value and light is output by the light emitter 102 in proportion to the charge on the capacitor 106. The reset signal 26 drives the reset transistor 38 to bias the photo-diode 34 to Vdd. When the reset signal 26 is removed, the photodiode begins to discharge in response to light from the light emitter 102 at a rate proportional to the intensity of the emitted light. This signal is converted to a voltage by the amplifier transistor 36 and is available on the output of read-out transistor 40 on line 60 as long as the read-out transistor is selected. If the read-out transistor 40 is controlled by the select line 24, the output from the read-out circuit will be available from the end of the reset signal 26 to the end of the select signal 24. If the read-out transistor 40 is controlled by an external select line 39, the output will be available as long as the external select signal is on and from the end of the reset signal 26 until the photodiode is completely discharged. The output voltage is measured as is known in the prior art for photodiode image sensors after the end of the reset signal by the output circuit 15 to determine the light level output by the light emitter 102.

Figure 5:
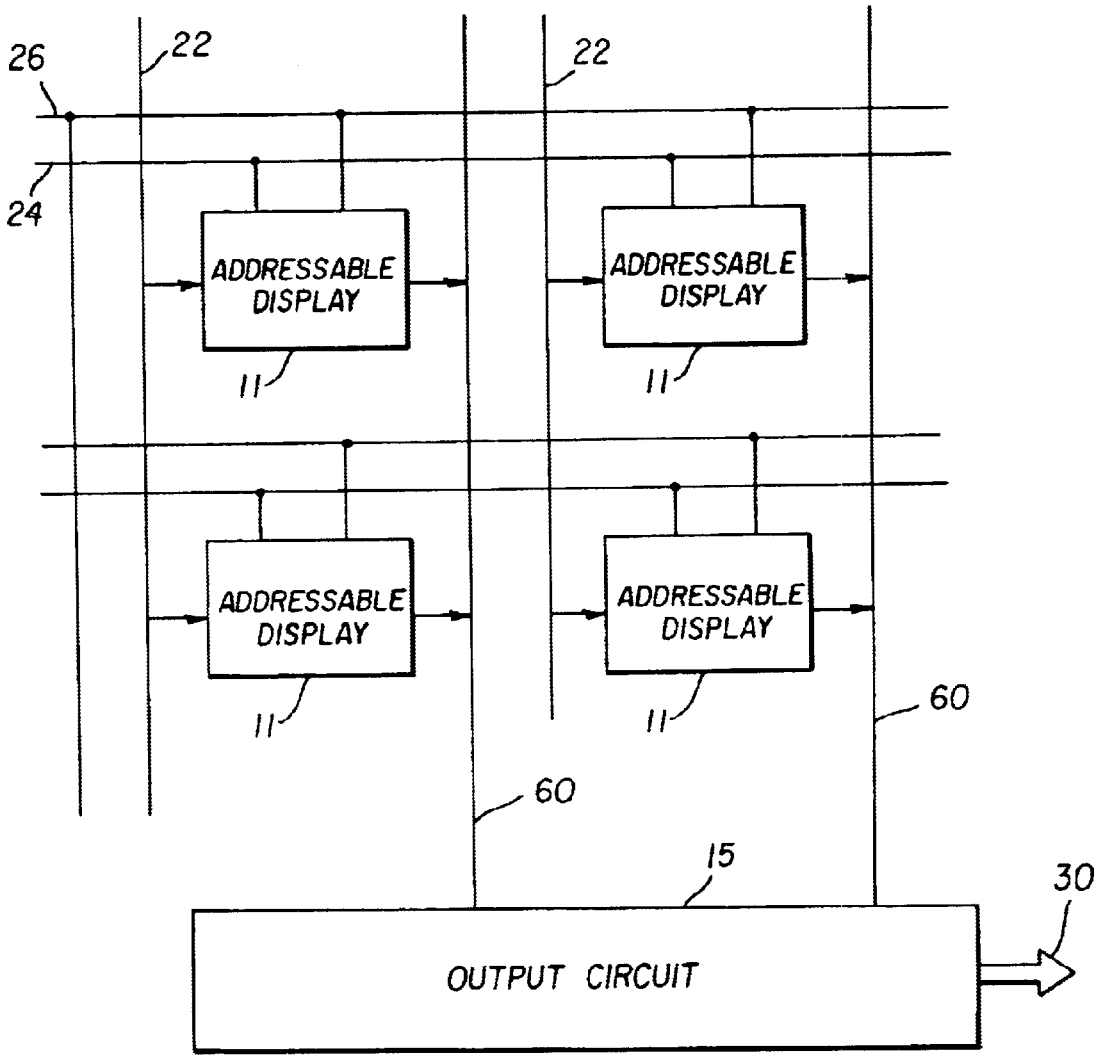
FIG. 5 is a circuit diagram of a plurality of addressable display device pixels according to an embodiment of the present invention.

Referring to FIG. 5, an array of addressable pixels according to one embodiment of the present invention is shown. Data, select, and reset signals 22, 24, and 26 respectively are shown connected to a two-by-two array of addressable pixels 11. The read-out lines 60 connected to the output circuit 15 are common over each column of the array.

When activated, some of the light emitted from the light emitters 102 of the addressable pixels is directly detected by the photo-sensor 34. The photo-sensor(s) are optically coupled to the light emitters and absorb light from the light emitters either directly (where the photo-sensors are located adjacent to the light emitters—with no intervening optical boundaries), or indirectly through reflection or transmission through one or more layers. The photo-sensors may be located on the substrate directly above or below the light emitters, or they may be located on the substrate coplanar with the light emitters.

The present invention is not limited to one photo-sensor per light emitter. Groups of light emitters can be sensed by a single photo-sensor to reduce the number of photo-sensors in the array, or to provide a measure of light over larger areas of the array thus simplifying the supporting logic and interconnects. The signals from the photo-sensors can also be combined in signal processing electronics to provide average signals for correcting for example for color imbalances over a whole array, or portions of an array. In particular, a photo-sensor may be coupled to a single color element of a three-color pixel or to the entire pixel as a whole.

The feedback signal detected from the photo-sensor elements can be used to provide feedback from the light detected in the display control circuit to compensate for changes or differences in light output from pixels. Generally speaking, the signal generated is compared to a priori knowledge of the signal generated at the desired luminance (a reference). This knowledge can be obtained from various sources, such as a model of emitter behavior, measurements on an exemplary display, or experience with similar displays in the past. The current driving the display materials is then increased or decreased until the signal from the photo-sensor matches the desired signal. When this occurs, the light generated by the light emitters is at the desired level. Note that as the light emitters degrade over time, become less efficient, and emit less light, the resulting photo-electric current will decrease, causing an increase in driving current to compensate for the reduced light output.

Ambient light may also pass through the emissive layers, substrate, or cover into the photo-sensors. The optically coupled light from the light emitter and ambient light is then detected by the photo-sensor. Compensation can be made for this situation. The simplest mechanism for distinguishing between ambient and display light is to first measure the ambient light current. This is done simply by applying zero current to the light emitting pixels so that the pixels emit no light. Any residual signals from the photo-detectors will be due to ambient radiation and any reference comparison may adjust for this residual signal. This reference adjustment can be done at the time the display device is powered up or periodically while it is in use.

A reference adjustment can also be used to automatically compensate for changes in the ambient environment. When viewed in a dark environment (little ambient radiation), a display device need not be as bright as when viewed in a lighter environment (more ambient radiation). If the display device light output is re-calibrated periodically, it will maintain a fixed difference between the ambient and displayed light even if the ambient light changes. This can, in turn, increase display device lifetime by reducing unnecessary display brightness in a dark environment and increase display device visibility in a bright environment. If brightness compensation is done on a pixel address basis, it is even possible to correct different parts of the display in different ways, correcting for devices that may be partly shaded, for example.

The feedback circuitry is integrated directly onto the same substrate as the display device. In general, higher performance and greater accuracy can be achieved by integrating the circuitry directly with the display device.

In one embodiment, the light emitters 102 are organic light emitting diodes (OLEDs). The photo-diode 34 can be fabricated of semi-conductor materials whose deposition and processing are compatible with the light emitters 102, for example traditional crystalline silicon, poly-silicon, or amorphous silicon materials. Any other compatible photo-sensor materials may also be used, for example, the photo-diodes 34 can be composed of organic semiconductor materials disposed between electrodes so as to be responsive to light.

The light emitting elements of the addressable pixels of the present invention can be Organic Light Emitting Diodes (OLEDs) including small molecule polymeric OLEDs as disclosed in but not limited to U.S. Pat. No. 4,769,292, issued Sep. 6, 1988 to Tang et al.; and U.S. Pat. No. 5,061,569 issued Oct. 29, 1991 to VanSlyke et al. Many combinations and variations of OLED materials would be apparent to those knowledgeable in the art and can be used to fabricate such a device and are included in this invention.

The present invention provides a highly integrated means to provide optical feedback to an array of emissive pixels in a display. This feedback can lengthen the device lifetime, reduce power consumption, improve the image quality, and provide flexibility in application.

The invention has been described in detail with particular reference to certain embodiments thereof, but it will be understood that variations and modifications can be effected within the spirit and scope of the invention.

PARTS LIST

10 image display
11 addressable display
12 display pixel array
13 display input signals
14 display control circuit
15 output circuit
16 address control circuit
22 data signals
24 select signals
26 reset signal
30 feedback signal
32 data signal
34 photo-diode
36 transistor amplifier
38 reset transistor
39 photo sensor select line
40 readout transistor
60 feedback signal line
100 Vdd power line
102 LED
104 drive transistor
106 capacitor
108 switch transistor

What is claimed is:

1. An addressable image display pixel, comprising:

a) a substrate;

b) a light emitter formed on the substrate;

c) a photo-sensor formed on the substrate and optically coupled to the light emitter to detect light emitted by the light emitter to generate a feedback voltage signal in response to light emitted by the light emitter; and, d) a feedback readout circuit formed on the substrate and responsive to the feedback voltage signal to provide a feedback signal representing the light output of the light emitter, the feedback readout circuit including a transistor amplifier, means for resetting the readout circuit, and a select switch.

2. The addressable image display pixel claimed in claim 1, wherein the photo-sensor is a photodiode.

3. The addressable image display pixel claimed in claim 1, wherein the photo-sensor is a photo-capacitor, and wherein the feedback readout circuit further includes a transfer gate for transferring photo charge from the photo-capacitor to the transistor amplifier.

4. The addressable image display pixel claimed in claim 2, wherein the photo-sensor is an organic or silicon semiconductor.

5. The addressable image display pixel claimed in claim 1, wherein the light emitter is an organic light emitting diode.

6. The addressable image display pixel claimed in claim 1, wherein the means for resetting the feedback circuit is a reset transistor switch responsive to a reset signal for initializing the photo-sensor.

7. The addressable image display pixel claimed in claim 1, wherein the means for resetting the feedback circuit is a reset line for initializing the photo-sensor.

8. The addressable image display pixel claimed in claim 1, wherein the addressable light emitter is addressable by a select signal and the feedback readout circuit is responsive to the select signal to output the feedback signal.

9. The addressable image display pixel claimed in claim 1, wherein the addressable light emitter is addressable by a select signal and the feedback readout circuit is responsive to a separate photo-sensor select signal to output the feedback signal.

10. The addressable image display pixel claimed in claim 1, further comprising a plurality of light emitters formed on the substrate.

11. The addressable image display pixel claimed in claim 1, wherein the light emitters are colored light emitters in a color pixel.

12. A display device, comprising:

a) display pixel array, having i) a substrate; and ii) a plurality of addressable image display pixels formed on the substrate, each image display pixel including a light emitter, a photo-sensor optically coupled to the light emitter to detect light emitted by the light emitter to generate a feedback voltage signal in response to light emitted by the light emitter; and, a feedback readout circuit formed on the substrate and responsive to the feedback voltage signal to provide a feedback signal representing the light output of the light emitter, the feedback readout circuit including a transistor amplifier, means for resetting the readout circuit, and a select switch; and b) a display control circuit for receiving display input signals and modifying the display input signals in response to the feedback signals from the addressable display pixels.

13. The display device claimed in claim 12, wherein the photo-sensors are photodiodes.

14. The display device claimed in claim 12, wherein the photo-sensors are photo-capacitors, and wherein the feedback readout circuits further include a transfer gate for transferring photo charge from the photo-capacitors to the transistor amplifiers.

15. The display device claimed in claim 12, wherein the photo-sensors are organic or silicon semiconductors.

16. The display device claimed in claim 12, wherein the light emitters are organic light emitting diodes.

17. The display device claimed in claim 12, wherein the means for resetting the feedback circuit are reset transistor switches responsive to a reset signal for initializing the photo-sensors.

18. The display device claimed in claim 12, wherein the means for resetting the feedback circuit is a reset line for initializing the photo-sensors.

19. The display device claimed in claim 12, wherein the addressable light emitters are addressable by a select signal and the feedback readout circuits are responsive to the select signal to output the feedback signal.

20. The display device claimed in claim 12 wherein the addressable light emitter is addressable by a select signal and the feedback readout circuit is responsive to a separate photo-sensor select signal to output the feedback signal.

21. The display device claimed in claim 12, wherein the image display pixels include a plurality of individually addressable light emitters.

22. The display device claimed in claim 21, wherein the plurality of light emitters are differently colored light emitters and the image display pixel is a color pixel.

23. The display device claimed in claim 21, wherein the plurality of light emitters emit the same color of light.

24. The display device claimed in claim 12, further comprising a plurality of addressable display pixels without photo-sensors.

25. The display device claimed in claim 12, further comprising an address control circuit for applying the modified display input signals to the display pixel array.

* * * * *